United States Patent [19]

Saunders

[11] 4,269,546

[45] May 26, 1981

[54] MINE WORKING APPARATUS

[75] Inventor: Graham J. Saunders, Newcastle on Tyne, Great Britain

[73] Assignee: Huwood Limited, Tyne and Wear, England

[21] Appl. No.: 31,226

[22] Filed: Jun. 4, 1979

[30] Foreign Application Priority Data

Apr. 20, 1978 [GB] United Kingdom ..... 15637/78

[51] Int. Cl.[3] ..... E21D 17/05

[52] U.S. Cl. ..... 405/294; 405/296

[58] Field of Search ..... 405/291, 293, 296, 294; 91/170 MP; 299/31, 33

[56] References Cited

U.S. PATENT DOCUMENTS 3,889,475 6/1975 Allen ..... 405/294

FOREIGN PATENT DOCUMENTS 2420244 11/1975 Fed. Rep. of Germany ..... 405/291

1037734 8/1966 United Kingdom ..... 405/294

1270115 4/1972 United Kingdom ..... 405/293

*Primary Examiner*—David H. Corbin

*Attorney, Agent, or Firm*—Kemon & Estabrook

[57] ABSTRACT

The invention relates to mine working apparatus including a sprag plate 21. The sprag plate 21 is included in a sprag unit 20 that can be reciprocated in the fore-and-aft direction of the canopy and the sprag unit 20 includes a sprag slide 22 and a link system 43 and 61 that can be reciprocated in the fore-and-aft sense relatively to each other. There is a range of lost motion between the slide 22 and the link system and the means 48 for moving the sprag unit between the position in which the sprag plate 21 is operative and the position in which the sprag plate 21 is inoperative also moves the sprag slide and the link system relatively to each other through their range of lost motion and this relative movement swings the sprag plate 21 between a generally upright, operative, position and a generally horizontal, retracted, position.

8 Claims, 6 Drawing Figures

MINE WORKING APPARATUS

This invention relates to mine working apparatus and arose from a consideration of the problems met in longwall mining.

In known longwall mining practice, a row of mine roof supports is aligned along the coal face with an endless conveyor disposed between them and the coal face. A widely known form of such supports has a canopy by which the roof of the mine above them and the conveyor is supported and a forepole which may be extended to support the extension of the roof that is newly created by the action of a cutter moving in front of the supports along the wall. Now the action of the cutter that extends the roof will also create a new upright wall and various proposals have been made by which a sprag plate can be held against the upright wall to support it and the present invention provides mine working apparatus including a sprag plate.

According to the present invention there is provided mine working apparatus provided with a sprag plate by which an upright wall adjacent, and forwardly of, the apparatus can be supported, in which the sprag plate is pivotally mounted on the forward end of a support, the support is carried by a part of the apparatus relatively to which it is reciprocable in the fore-and-aft direction, actuating means is provided to effect reciprocation of the support and is such that forward movement of the actuating means effects, except for a range of such movement when the actuating means moves relatively to the support, forward movement of the support and rearward movement of the actuating means effects, except for a range of such movement when the actuating means moves relatively to the support, rearward movement of the support, and a link is pivotally connected at spaced locations to the actuating means and to the sprag plate and is such that when the actuating means is at the forward end of the range in which it can move forward relatively to the support, the link holds the sprag plate in an upright, wall supporting position and when the actuating means is at the rearward end of the range in which it can move rearwardly relatively to the support, the link holds the sprag plate in a retracted position.

By way of example, an embodiment of the invention will now be described with reference to the accompanying drawings in which.

Figures 1, 3:
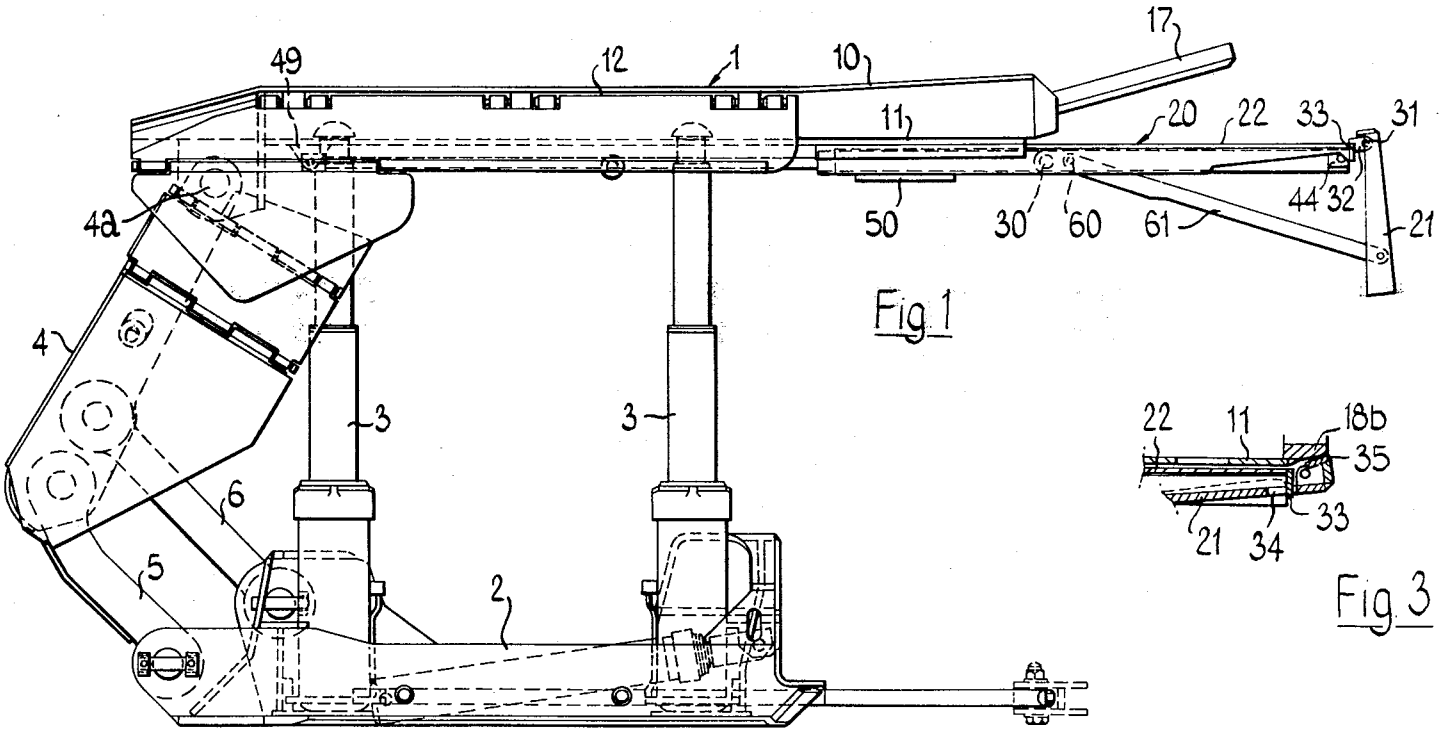
FIG. 1 shows in side view a mine roof support that embodies the present invention.
FIG. 3 shows a detail of FIG. 2 after adjustment from the condition in which it is shown in FIG. 2.

The roof support shown in FIG. 1 comprises a canopy, indicated generally at 1, supported from a base 2 by four hydraulic rams 3, of which only two appear in the drawing. By adjustment of the rams 3, the separation between the base 2 and the canopy 1 can be varied to bring the canopy 1 into supporting contact with the roof of a mine. A goaf shield 4 is pivotally connected, at 4*a*, to the rear end of the canopy 1 and pairs of links 5 and 6, spaced apart across the width of the support, are pivotally connected at an end to the goaf shield 4 and at the other end to the base 2. The links 5 and 6 form a so-called "lemniscate linkage" and their effect is to ensure that the connection between the goaf shield 4 and the canopy 1 moves more-or-less in parallel with the axes of the rams 3 when the rams are operated so as to limit any forces acting laterally of the rams 3. The connection 4*a* is such as to permit the canopy 1 to tilt laterally relatively to the goaf shield 4 to take up irregularities in the mine roof.

Figure 2:
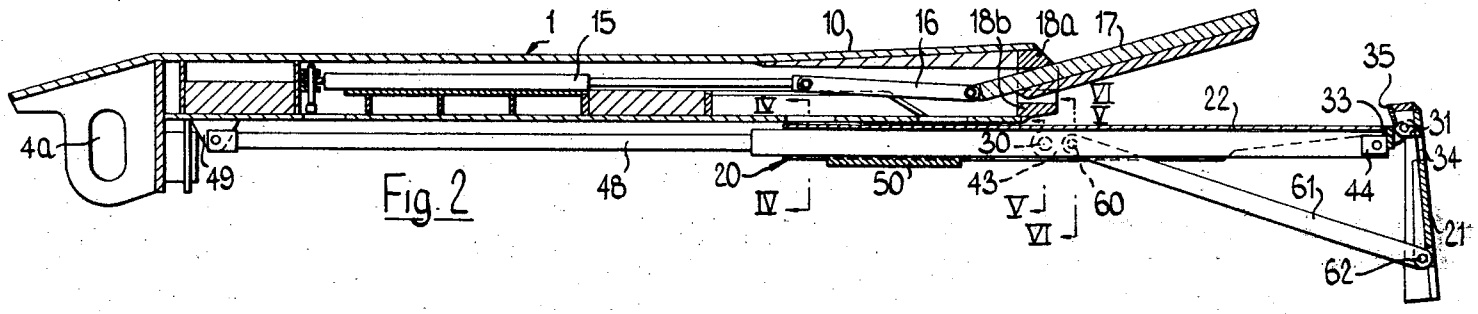
FIG. 2 shows, on a somewhat larger scale, in length ways section, taken just to one side of the central plane, the canopy of the support and a sprag unit mounted on the underside of the canopy.

The canopy 1 comprises a top plate 10 and a bottom plate 11 and pivotted flaps 12 hang down from the canopy across the upper ends of the rams 3. Between the plates 10 and 11 there are two forepole units. The units lie one to each side of the longitudinal centre line of the canopy and each unit includes a hydraulic forepole ram 15 connected through a pivoted link 16 to the forepole plate 17. The forepole plate 17 co-operates with guides 18*a* and 18*b* at the leading ends of the plates 10 and 11 and by operation of the ram 15, the forepole plate 17 can be moved between the roof-supporting position in which it is shown in FIGS. 1 and 2 and a position in which it lies retracted between the plates 10 and 11.

Below the canopy 1, and fixed to the underside of the lower plate 11 and centrally of the canopy is a sprag unit indicated generally at 20. The sprag unit 20 includes the sprag plate 21 that can be held forwardly of the rest of the support (as it is shown in FIGS. 1 and 2) to support the upright face in front of the support but that can also be retracted to a position, in which it is shown in FIG. 3, in which it lies generally horizontally and wholly beneath the lower plate 11. When the sprag plate 21 is fully extended, as shown in FIGS. 1 and 2, it lies beyond the forward ends of the forepole 17 and is inclined forwardly at an angle of about 5° to the vertical.

The sprag plate 21 is carried by the leading end of a support beam in the form of a sprag slide 22 that is reciprocable in the fore-and-aft direction, being supported during such motion on a pair of guide bars 23 forming runners extending lengthwise of, and bolted to the lower side of, the lower plate 11.

Figure 4:
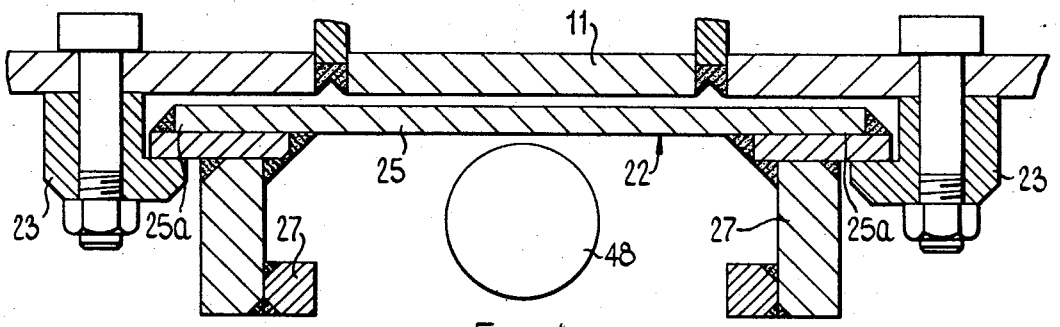
FIG. 4 shows, on an even larger scale, a section on line IV—IV of FIG. 2.
Figure 5:
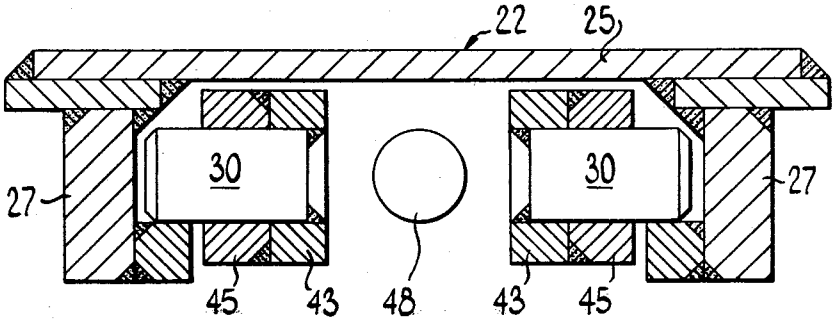
FIG. 5 shows, on the same scale, a section on line V—V of FIG. 2.
Figure 6:
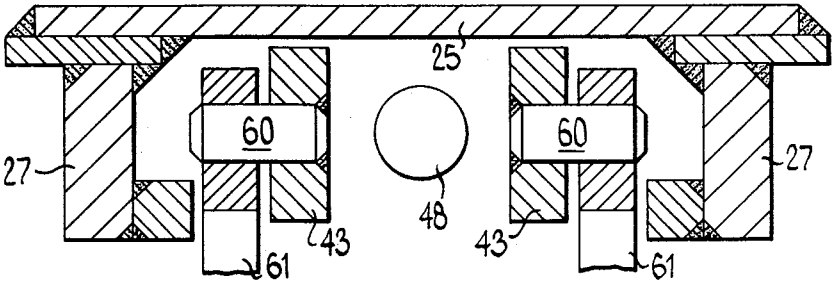
FIG. 6 shows, on the same scale, a section on line VI—VI of FIG. 2.

As will be seen from FIG. 4, the sprag slide 22 comprises an upper panel 25 of which the longitudinal edges 24*a* form flanges acting as slides co-operating with the runners 23. Parallel to the runners 23, and welded to the underside of the panel 25, are pin guides 27 serving as guide tracks along which the pins 30 (see FIG. 5) can reciprocate lengthwise of the sprag slide 22. The pins 30 are included in a link system by which, as will shortly be described, the sprag plate 21 can be swung between the positions in which it is shown in FIGS. 2 and 3.

The connection of the sprag plate 21 to the leading end of the sprag slide 22 is effected by the bearing 31 that is carried in brackets 32. The brackets 32 project forwardly from an abutment plate 33 welded into the front end of the sprag slide 22, and the sprag plate 21 is provided with an opening 34 in which the abutment plate 33 lies when the sprag plate 21 has been turned to the retracted position by which it is shown in FIG. 3. When the sprag plate 21 is in its operative position, most lies below the bearing 31, but an extension lies above the bearing 30. The rear of the extension carries a buffer strip 35 of which the purpose will be explained later.

The link system includes a pair of parallel links 43 connected together by a nose 44 at their forward ends. At their rear ends, each link carries a re-inforcement 45 and each pin 30 is held by a link 43 and it re-inforcement 45 to project into sliding co-operation with a guide 27.

The outer end of the piston of an hydraulic ram 48 is connected at its rear end to brackets 49 that are rigidly mounted on the lower plate 11 of the canopy. The outer end of the cylinder of the ram 48 is connected at its front end to the nose 44 and a plate 50, that is connected at its sides to the lower plate 11 serves as a support for the ram 48.

Forwardly of the pins 30, each link 43 is provided with an outwardly projecting pin 60. Each pin 60 acts as a pivot for one end of a link 61 that is pivotally connected at its other end, at 62, to the free end of the sprag plate 21. The pins 60 and 30 are aligned with the nose 44.

Now suppose the canopy is displayed in the manner in which it is shown in FIGS. 1 and 2 and it is wished to move the roof support forwards. The ram 48 serves as actuating means and is contracted, which will withdraw the nose 44 from the forward end of the sprag slide 22, the two links 43 moving rearwardly with the nose 44. The ram 48 being supported by the plate 50, the front end of the ram 48 provides sufficient support for the front ends of the links 43; support for the rear ends of the links 43 is provided by the pins 30 sliding on the guides 27. During movement of the links 43, the pins 30 and 60 move along the direction in which they are aligned.

Retraction of the links 43 will retract the pins 60 that are fixed to them. Since the links 61 are of fixed length, and the sprag plate 21 is pivoted to the end of the sprag slide 22, retraction of the pins 60 will swing the sprag plate 21 towards the position relatively to the sprag slide 22 in which it is shown in FIG. 3. Further retraction of the ram 48 will, through the connection represented by the links 61 and the sprag plate 21, effect retraction of the sprag slide 22 with the flanges **25*a* sliding along the runner 23. When the sprag slide 22 is fully retracted, the buffer strip 35 will co-operate with the under face of the guides 18*b* which acts as a cam surface to ensure that the sprag plate 21 remains in the position in which it is shown in FIG. 3. The forepole 17** is then withdrawn and the support can be moved forward towards the coal face.

When a new face has been cut, the forepole 17 is again projected to support the roof and the sprag plate 21 is projected into its face supporting position. For this purpose, the ram 48 is extended and the first effect of this will be to move the buffer strip of the sprag plate 21 out of co-operation with the guide **18*b*, when the sprag plate 21 will tend to fall towards its operative position. Further extension of the ram 48 beyond this will move the nose 44 further in the direction of the end of the sprag slide 22 until the sprag plate 21 is in the operative stance in which it is shown in FIGS. 1 and 2, and the nose 44 is in contact with the abutment plate 33. Friction will tend to prevent movement of the sprag slide 22 until the sprag plate 21 has reached this stance but further extension of the ram 48 will through the co-operation of this nose 44 with the plate 33, move the sprag slide 22 forwards until the sprag plate 21 is in engagement with the coal face. It will be realised that the sprag plate 21** will be upright as it approaches the coalface so that it will be effective to deflect any pieces of coal that may fall during that operation.

In the embodiment that has been described, it is supposed that friction will hold the sprag slide 22 fixed relatively to the canopy 1 whilst, during forward operation of the ram 48 the sprag plate 21 moves completely from its fully retracted to its fully upright position. Friction will also hold the sprag slide 22 whilst, during reverse operation of the ram 48, the sprag plate 21 swings from its upright position back to its fully retracted position. In other embodiments, however, there may be reciprocable movement of the sprag slide 22 simultaneously with pivoted movement of the sprag plate 21 or, when forward movement of the ram 48 is possible, reciprocable movement of the sprag slide 22 may precede pivotal movement of the sprag plate.

Valve means may be provided to ensure that the sprag plate 21 is "locked out" when in its operative position. Means may also be provided to ensure that the sprag plate 21 is fully retracted before the mine roof support can move forwardly.

I claim:

1. Mine working apparatus provided with a sprag plate by which an upright wall adjacent, and forwardly of, the apparatus can be supported, in which the sprag plate is pivotally mounted on the forward end of a support, the support is carried by a part of the apparatus relatively to which it is reciprocable in the fore-and-aft direction, actuating means is provided to effect reciprocation of the support and is such that forward movement of the actuating means effects, except for a range of such movement when the actuating means moves relatively to the support, forward movement of the support and rearward movement of the actuating means effects, except for a range of such movement when the actuating means moves relatively to the support, rearward movement of the support, and a link is pivotally connected at spaced locations to the actuating means and to the sprag plate and is such that when the actuating means is at the forward end of the range in which it can move forwards relatively to the support, the link holds the sprag plate in an upright, wall-supporting position and when the actuating means is at the rearward end of the range in which it can move rearwardly relatively to the support, the link holds the sprag plate in a retracted position.

2. Apparatus as claimed in claim 1 in which the forward limit of the range of forward movement of the actuating means relatively to the support is established by abutment of the actuating means with the support.

3. Apparatus according to claims 1 or 2 in which, at the rearward limit of the range of movement of the actuating means rearwardly relatively to the support, the line of the pivots of the link extends parallel to the direction of reciprocation.

4. Apparatus according to claims 1 or 2 in which the sprag plate is provided with an extension lying on the opposite side of the axis about which the sprag poate is pivoted, and the part of the apparatus relatively to which the support is reciprocable is provided with a cam surface such that movement of the support in the rearward direction brings the extension into such co-operation with the cam surface that, with the support stationary, the co-operation maintains the sprag plate in a retracted position.

5. Apparatus according to claims 1 or 2 in which actuating means includes a reciprocating ram of which one component is fixed, rearwardly of the moving component relatively to the part of the apparatus relatively to which the support is reciprocable in the fore-and-aft direction.

6. Apparatus according to claims 1 or 2 in which the support is carried by, and below, and is reciprocable relatively to, a canopy included in apparatus.

7. Apparatus according to claims 1 or 2 in which actuating means includes a reciprocating ram of which one component is fixed, rearwardly of the moving component, relatively to the part of the apparatus relatively to which the support is reciprocable in the fore-and-aft direction, two arms disposed one on each side of the ram are connected at their leading ends to the moving component of the ram, the tailing ends of the arms co-operate with slides carried by the support, and the link is one of two similar links pivotally connected one to each of the arms.

8. Apparatus according to claims 1 or 2 in which the support is carried by and below, and is reciprocable relatively to, a canopy that incorporates a reciprocable forepole, and the maximum forward reached of the sprag plate is greater than the maximum forward reach of the forepole.

* * * * *